US006954597B2

(12) United States Patent
Choi

(10) Patent No.: US 6,954,597 B2
(45) Date of Patent: Oct. 11, 2005

(54) ELECTROPHOTOGRAPHIC IMAGE-FORMING APPARATUS USING TWO-COMPONENT DEVELOPER AND PRINT DENSITY CONTROL METHOD THEREOF

(75) Inventor: Jeong-jai Choi, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/860,061

(22) Filed: Jun. 4, 2004

(65) Prior Publication Data

US 2005/0089341 A1 Apr. 28, 2005

(30) Foreign Application Priority Data

Oct. 23, 2003 (KR) ..... 10-2003-0074130

(51) Int. Cl.[7] ..... G03G 15/10

(52) U.S. Cl. ..... 399/55; 399/30; 399/50; 399/53; 399/58; 399/59

(58) Field of Search ..... 399/50, 53, 55, 399/58, 59

(56) References Cited

U.S. PATENT DOCUMENTS 6,330,405 B1 * 12/2001 Ishii et al. ..... 399/55
6,760,553 B2 * 7/2004 Mitsuya et al. ..... 399/38
6,845,222 B2 * 1/2005 Takai ..... 399/88

FOREIGN PATENT DOCUMENTS

| | | | |
|---|---|---|---|
| JP | 02091664 | 3/1990 | G03G/15/06 |
| JP | 05210288 | 8/1993 | G03G/15/06 |
| KR | 1999011499 | 2/1999 | G03G/15/10 |
| KR | 2002070589 | 9/2002 | G03G/15/10 |

* cited by examiner

*Primary Examiner*—Arthur T. Grimley
*Assistant Examiner*—Peter Lee
(74) *Attorney, Agent, or Firm*—Roylance, Abrams, Berdo, & Goodman, LLP

(57) ABSTRACT

An electrophotographic image-forming apparatus and method using a two-component developer comprises a charging roller for charging a surface of a photosensitive medium at a predetermined potential; a developing unit for developing an electrostatic latent image formed on the photosensitive medium; a control unit for determining a developing bias voltage to be applied to a developing roller in relation to a print density level selected by a predetermined selection unit out of a plurality of print density levels set in varying degrees, calculating a surface potential of the photosensitive medium charged by the charging roller, and controlling a charging voltage to be applied to the charging roller in order that an absolute value of a potential difference between the determined developing bias voltage and calculated surface potential becomes higher than a predetermined potential; and a charging voltage adjustment unit for variably adjusting the charging voltage to be applied to the charging roller.

8 Claims, 3 Drawing Sheets

ELECTROPHOTOGRAPHIC IMAGE-FORMING APPARATUS USING TWO-COMPONENT DEVELOPER AND PRINT DENSITY CONTROL METHOD THEREOF

This application claims priority under 35 U.S.C. § 119(a) to Korean Patent Application No. 2003-74130, filed on Oct. 23, 2003, the entire contents of which is incorporated herein by reference.

BACKGROUND OF THE INVENTION

1. Field of the Invention

The present invention relates to an electrophotographic image-forming apparatus using a two-component developer and a print density control method thereof. More particularly, the present invention relates to an electrophotographic image-forming apparatus using a two-component developer and print density control method capable of adjusting a developing bias voltage to control a print density.

2. Description of the Related Art

Electrophotographic developing systems are generally employed in image-forming apparatuses such as photocopiers, laser beam printers (LBPs), light-emitting diode (LED) printers, and plain paper facsimile machines.

The electrophotographic developing system operates to develop electrostatic latent images formed on a photosensitive medium into visible images using developers and transfers the visible images onto a printing medium for printing. Such developing systems are mainly classified into a one-component developing system using a toner only, and a two-component developer such as a mixture of a carrier and a toner.

In the developing system using the two-component developer, it is important to control the ratio of toner to carrier in order to obtain a high-quality images. In other words, it is important to control the concentration of a developer because the concentration of a developer is an important factor that determines the image quality.

When the electrostatic latent image on the photosensitive medium is developed, a developing bias voltage applied to a developing roller determines an amount of toner to be finally supplied to the photosensitive medium. The developing bias voltage is generally set to a voltage of, for example, −500V, to enable optimum images to be obtained. However if the developing bias voltage varies when a surface potential of the photosensitive medium is maintained at a certain voltage of, for example, −700V due to a charging voltage, a potential difference between the surface potential of the photosensitive medium and the developing bias voltage increases or decreases so that too much or too little toner is supplied on the photosensitive medium, which leads to a higher or a lower print density to cause a secondary factor that degrades the print quality.

Accordingly, a method is needed which can control the developing bias voltage to not only solve the problem of degrading print quality but also to efficiently control the print density.

SUMMARY OF THE INVENTION

The present invention has been developed in order to solve the above drawbacks and other problems associated with the conventional arrangement. An aspect of the present invention is to provide a two-component developer and developer concentration control method, capable of not only adjusting a developing bias voltage applied to a developing roller to control print density, but also automatically adjusting a charging voltage in response to the adjustment of the developing bias voltage for printing in the print density desired by users.

The foregoing and other objects and advantages are substantially realized by providing an electrophotographic image-forming apparatus using a two-component developer according to an embodiment of the present invention. The apparatus comprises a charging roller for charging a surface of a photosensitive medium at a predetermined potential; a developing unit for developing with a developer an electrostatic latent image formed on the photosensitive medium; a control unit for determining a developing bias voltage to be applied to a developing roller of the developing unit in relation to a print density level selected by a predetermined selection unit out of a plurality of print density levels set in multiple steps, calculating a surface potential of the photosensitive medium charged by the charging roller, and controlling a charging voltage to be applied to the charging roller in order that an absolute value of a potential difference between the determined developing bias voltage and calculated surface potential becomes higher than a predetermined potential; and a charging voltage adjustment unit controlled by the control unit, and for variably adjusting the charging voltage to be applied to the charging roller.

In one embodiment, the predetermined potential comprises 200V, or substantially 200V.

The electrophotographic image-forming apparatus further comprises a developing voltage adjustment unit controlled by the control unit, and for variably adjusting the developing bias voltage to be applied to the developing roller. In one embodiment, the control unit controls the developing voltage adjustment unit in order that the developing bias voltage set in correspondence to the print density level selected by the predetermined selection unit is applied to the developing roller.

The control unit calculates the surface potential of the photosensitive medium based on an equation as follows:

$$S=-(AX-Y(V)-K),$$

where 'S' denotes the surface potential of the photosensitive medium, 'A' denotes a slope value based on the lifespan characteristics of the photosensitive medium, 'X' denotes a lifespan count value of the developing unit, 'Y (V)' denotes a charging voltage according to environment controls, and 'K' denotes a constant value.

The electrophotographic image-forming apparatus further comprises a display unit for displaying a print density setting view in relation to a print density setting command; and an input unit for selecting any of the plurality of print density levels displayed on the print density setting view.

In order to achieve the above aspects, a print density control method for an electrophotographic image-forming apparatus is provided. The method uses a two-component developer provided with a charging roller for charging a surface of a photosensitive medium at a predetermined potential and a developing unit for developing with a two component developer an electrostatic latent image formed on the photosensitive medium. The method comprises the steps of determining a developing bias voltage to be applied to a developing roller in relation to a print density level selected by a predetermined selection unit out of a plurality of print density levels set in multiple steps. The method further comprises calculating a surface potential of the photosensitive medium charged by a charging voltage applied to the charging roller; and controlling the charging voltage applied to the charging roller based on the determined developing bias voltage in order that an absolute value of a potential difference between the determined developing bias voltage and calculated surface potential becomes higher than a predetermined potential.

Preferably, the surface potential calculation step calculates the surface potential of the photosensitive medium based on an equation as follows:

$$S=-(AX-Y(V)-K),$$

where 'S' denotes the surface potential of the photosensitive medium, 'A' denotes a slope value based on the lifespan characteristics of the photosensitive medium, 'X' denotes a lifespan count value of the developing unit, 'Y(V)' denotes a charging voltage according to environment controls, and 'K' denotes a constant value.

BRIEF DESCRIPTION OF THE DRAWINGS

The above aspects and features of the present invention will be more apparent by describing certain embodiments of the present invention with reference to the accompanying drawings, in which.

In the following description, it should be understood that the same drawing reference numerals are used for the same elements.

DETAILED DESCRIPTION OF THE PREFERRED EMBODIMENTS

Embodiments of the present invention will be described in greater detail with reference to the accompanying drawings.

Examples are used merely to provide a better understanding of the embodiments of the present invention. Thus, it is apparent that the present invention can be performed without the specified examples. Also, well-known functions or constructions are omitted for conciseness.

Figure 1:
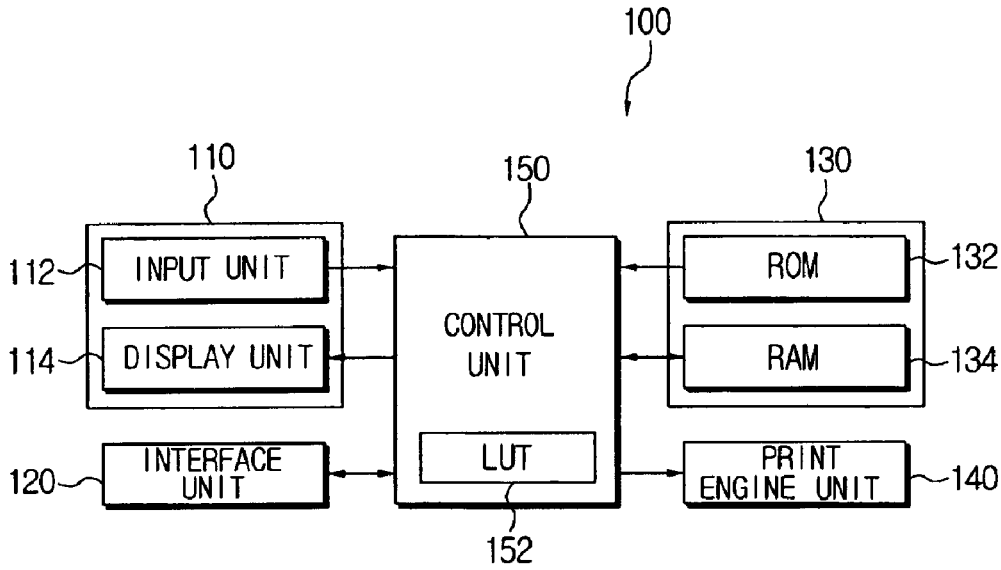
FIG. 1 is a block diagram illustrating an electrophotographic image-forming apparatus employing a two-component developer according to an embodiment of the present invention.

FIG. 1 is a block diagram illustrating an electrophotographic image-forming apparatus using a two-component developer according to an embodiment of the present invention.

Referring to FIG. 1, an electrophotographic image-forming apparatus 100 has an operation panel 110, an interface unit 120, a memory unit 130, a print engine unit 140, and a control unit 150.

The operation panel 110 includes an input unit 112 and a display unit 114.

The input unit 112 is provided with a plurality of keys enabling users to set and select among the various functions that are supported by the electrophotographic image-forming apparatus 100. The input unit 112 applies operation signals to the control unit 150 according to users' key manipulations. The input unit 112 may have a key for inputting a print density setting command and a key for selecting a print density.

The display unit 114 indicates display information under control of the control unit 150. The display unit 114 displays a print density setting view indicating print density levels set in multiple steps in order for the users to select a print density level required upon printing tasks. The print density levels can be displayed in multiple ranges such as light, medium light, normal, a medium dark, dark, very dark. The print density levels of varying ranges may also be displayed in a graphic format.

The interface unit 120 is provided to connect external devices such as a computer in order to provide a communications interface between the external devices and the control unit 150. The interface unit 120 receives data to be printed from the external devices, or sends out print information to the external devices.

The memory unit 130 includes a ROM 132, a non-volatile memory device which stores necessary control programs for the execution of the functions of the electrophotographic image-forming apparatus 100, and a RAM 134, a volatile memory device which stores data occurring during the operations of the electrophotographic image-forming apparatus 100.

The print engine unit 140 performs printing tasks under the control of the control unit 150. The print engine unit 140 is provided with a charging unit, a light-scanning unit, a developing unit, a transfer unit, and a fixing unit. The print engine unit 140 performs printing tasks through several steps. The print engine performs a charging step of charging the photosensitive medium through the charging unit; an exposure step of scanning the charged photosensitive medium with light corresponding to image data and forming an electrostatic latent image; a developing step of developing the electrostatic latent image formed on the sensitive medium with a developer and forming a visible image; a transferring step of transferring the visible image formed on the photosensitive medium onto a printing medium such as a paper; and a fusing step of fixing the visible image transferred on the printing medium with heat and pressure.

Figure 2:
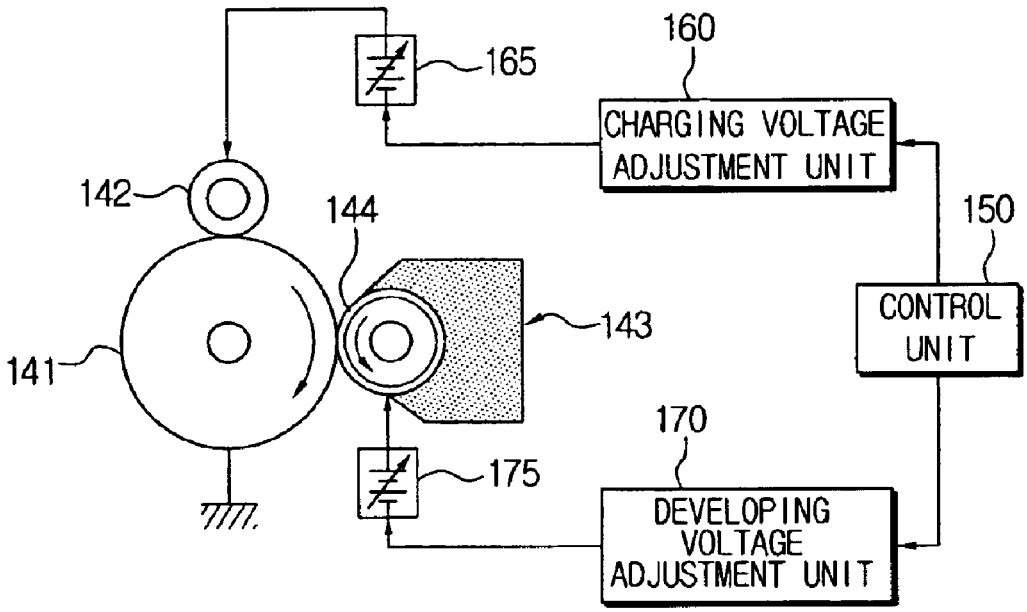
FIG. 2 is a block diagram illustrating a developing system of the electrophotographic image-forming apparatus shown in FIG. 1.

FIG. 2 is a block diagram illustrating a developing system of the electrophotographic image-forming apparatus shown in FIG. 1.

Referring to FIG. 2, a developing system has a photosensitive drum 141, a charging roller 142, a developing unit 143, a charging voltage adjustment unit 160, and a developing voltage adjustment unit 170.

The charging roller 142 charges a photosensitive medium 141 such as the photosensitive drum to a predetermined potential.

The charging voltage adjustment unit 160 controls a charging voltage varying unit 165 such that a charging voltage is applied to the charging roller 142 in correspondence with a control signal inputted from the control unit 150.

The charging voltage varying unit 165 varies and applies a charging voltage to the charging roller 142 according to the controls of the charging voltage adjustment unit 160.

The developing unit 143 develops with a developer an electrostatic latent image which is formed on the photosensitive drum 141 by a light-scanning unit (not shown). In this embodiment of the present invention, a two-component developer having a mixture of carrier and toner is used.

The developing voltage adjustment unit 170 controls the developing voltage varying unit 175 so that a developing bias voltage is applied to the developing roller 144 in relation to a control signal input from the control unit 150.

The developing voltage varying unit 175 varies and applies a developing bias voltage applied to the developing roller 144 via the developing voltage adjustment unit 170.

The control unit 150 controls overall the operations of the electrophotographic image-forming apparatus 100 according to control programs stored in the ROM 132. The control unit 150 provides the print density setting view through the display unit 114 in order to enable users to select among a plurality of print density levels having different ranges in relation to a print density setting command received through the input unit 112 provided on the operation panel 110. According to the selection made by the user among the plurality of print density levels displayed on the print density setting view, the control unit 150 controls the developing voltage adjustment unit 170 such that the predetermined developing bias voltage can be applied developing roller 144 in relation to the selected print density level.

The control unit 150 according to an embodiment of the present invention includes a lookup table (LUT) 152 (see FIG. 1) which stores information about the developing bias voltages to be applied to the developing roller 144 in relation to the print density levels set in multiple levels.

Table 1 shows the lookup table 152 stored in the control unit 150.

TABLE 1

| Steps | Developing density | Developing bias voltage |
|---|---|---|
| 1 | Lighter | −400 V |
| 2 | Light | −450 V |
| 3 | Normal | −500 V |
| 4 | Dark | −550 V |
| 5 | Darker | −600 V |
| 6 | Darkest | −650 V |

If a user selects any of the print density levels through the print density setting view displayed on the display unit 114, the control unit 150 provides a developing bias voltage corresponding to the print density level selected by the user from the lookup table 152, and applies a control signal corresponding to the read-out developing bias voltage to the developing voltage adjustment unit 170. For example, if the user selects 'Normal' corresponding to the step 3, the control unit 150 provides from the lookup table 152 a developing bias voltage of −500V set in relation to the 'Normal', and controls the developing voltage adjustment unit 170 in order for the provided developing bias voltage of −500V to be applied to the developing roller 144.

If the developing bias voltage to be applied to the developing roller 144 is determined, the control unit 150 calculates, based on Equation 1, a surface potential of the photosensitive drum 141 charged due to a charging voltage applied to the charging roller 142.

$$S=-(AX-Y(V)-K) \quad \text{(Equation 1)}$$

In Equation 1, 'S' denotes a surface potential of the photosensitive drum 141, 'A' denotes a slope value based on the lifespan characteristics of the photosensitive drum 141, 'X' denotes a lifespan count value of the developing unit 143, 'Y(V)' denotes a charging voltage according to environment controls, and 'K' denotes a constant value. The 'charging voltage according to environmental controls' refers to a charging voltage which is based on the changes of the effective resistance of the charging roller 142 according to environmental factors such as temperature and humidity. The surface potential of the photosensitive drum 141 changes due to not only a charging voltage applied to the charging roller 142 but also to the lifespan of the photosensitive drum 141 and the developing unit 143. The factors such as the slope value according to the lifespan characteristics of the photosensitive drum 141 and the lifespan count value of the developer are taken into account. The 'lifespan count value of the developer' refers to a value obtained by counting the number of times the developing unit has performed the printing tasks, which is incremented or decremented from an initial value. A counting unit that can count the lifespan of the developer is included in a memory (not shown) provided in the developing unit itself.

The control unit 150 calculates a surface potential of the photosensitive drum 141 obtained from Equation 1, and determines whether a developing bias voltage applied to the developing roller 144 meets the condition expressed in Equation 2.

$$|S-D|>200 \quad \text{(Equation 2)}$$

In Equation 2, 'S' denotes a surface potential of the photosensitive drum 141 calculated based on Equation 1, and 'D' denotes a developing bias voltage applied to the developing roller 144.

That is, the control unit 150 determines whether an absolute value of a potential difference between a developing bias voltage determined in relation to a print density level selected by a user and a calculated surface potential of the photosensitive drum 141 is higher than a value of a predetermined potential, for example, 200V. The predetermined potential is a potential difference between two potentials necessary for a developer loaded in the developing unit 143 to move to an electrostatic latent image formation unit of the photosensitive drum 141 through the developing roller 144, which is preferably about 200V.

If it is determined that the absolute value of a potential difference between a developing bias voltage applied to the developing roller 144 and a calculated surface potential of the photosensitive drum 141 is higher than 200V, the control unit 150 maintains the charging voltage as it is applied to the charging roller 142, whereas, if it is determined that the absolute value of the potential difference between the developing bias voltage applied to the developing roller 144 and the calculated surface potential of the photosensitive drum 141 is lower than 200V, the control unit 150 controls the charging voltage adjustment unit 160 such that a charging voltage having the absolute value of the potential difference become 200V can be applied to the charging roller 142.

For example, provided that a slope value based on the lifespan characteristics of the photosensitive drum 141 is set to 0.001, a lifespan count value of the developing unit is set to 10,000, a charging voltage applied to the charging roller 142 is set to −1300V, and a constant value is set to 675, then a calculated surface potential S of the photosensitive drum 141 becomes −635V when Equation 1 is used.

If a developing bias voltage determined in relation to a print density level selected by a user is −500V, the absolute value of a potential difference between a developing bias voltage applied to the developing roller 144 and a surface potential of the photosensitive drum 141 becomes 135V. That is, since the absolute value of the potential difference between the two potentials is lower than 200V, the control unit 150 controls the charging voltage adjustment unit 160 to increase by a certain level and applies a charging voltage to the charging roller 142. At this time, if the charging voltage applied to the charging roller 142 varies to −1400V, the surface potential S of the photosensitive drum 141 becomes −735V so that the absolute value of the potential difference between the two potentials becomes 235V. Since the potential difference between the two potentials is higher than 200V, the control unit 150 determines that the voltage of −1400V applied to the charging roller 142 is a charging voltage.

Hereinafter, a print density control method for electrophotographic image-forming apparatuses using a two-component developer according to an embodiment of the present invention will be described with reference to FIG. 3.

Figure 3:
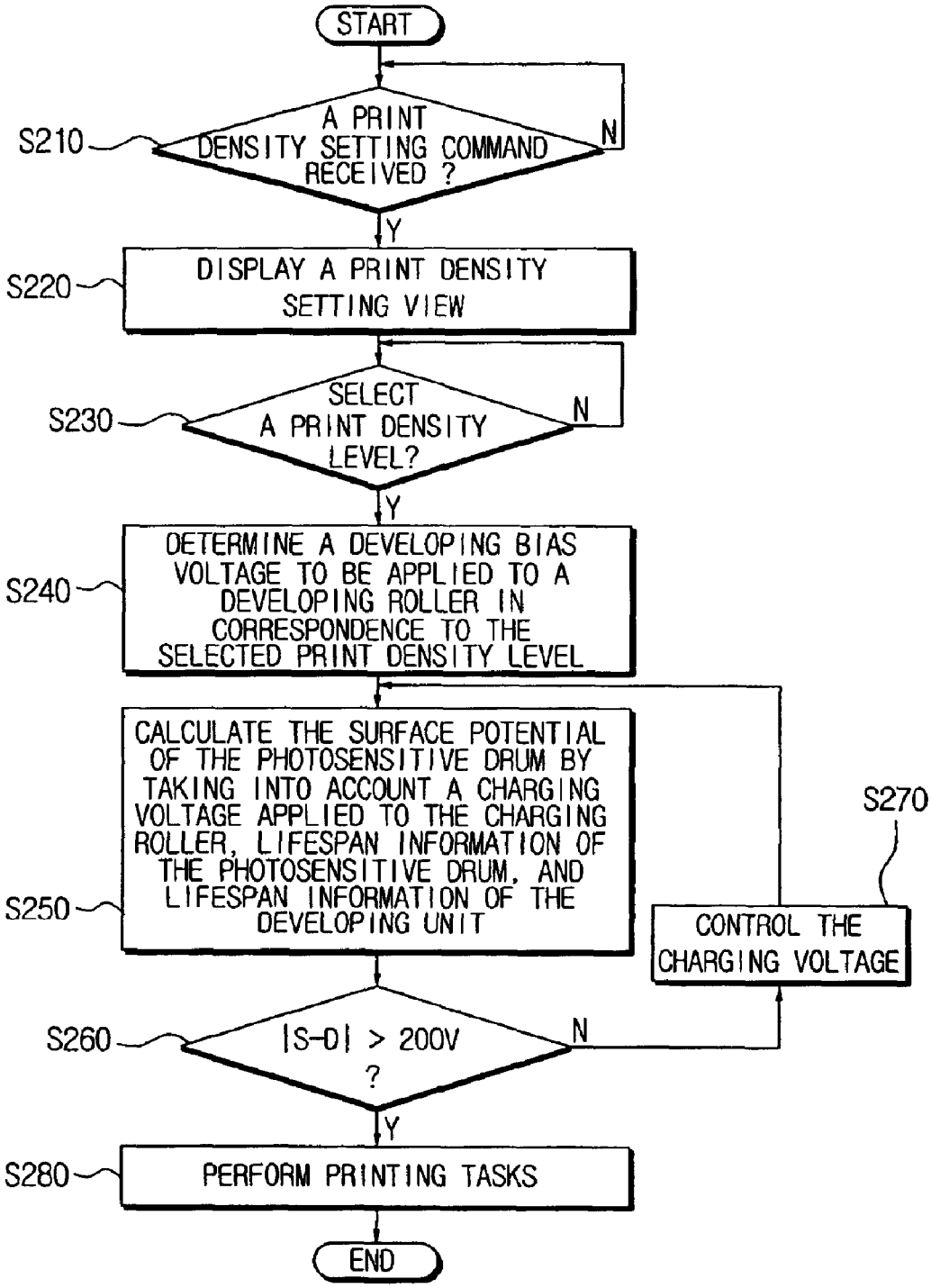
FIG. 3 is a flow chart illustrating a print density control process for the electrophotographic image-forming apparatus shown in FIG. 1.

Referring to FIG. 1 to FIG. 3, first, the control unit 150 determines whether a print density setting command signal is received through the input unit 112 (step S210). If it is determined that the print density setting command signal is received, the control unit 150 displays the print density setting view in order to enable a user to select the print density levels which vary in degree through the display unit 114 (step S220).

If the user selects any of the print density levels on the print density setting view displayed on the display unit 114 (step S230), the control unit 150 selects a developing bias voltage to be applied to the developing roller 144 in relation to the selected print density (step S240). That is, the control unit 150 retrieves from the lookup table 152 a developing bias voltage to be applied to the developing roller 144 in relation to the print density that the user has selected.

The control unit 150 calculates a surface potential of the photosensitive drum 141 by taking into account a charging voltage applied to the charging roller 142, the lifespan of the photosensitive drum 141, and the lifespan information of the developing unit 143.

After calculating the surface potential of the photosensitive drum 141, the control unit 150 determines whether the calculated surface potential of the photosensitive drum 141 and the developing bias voltage applied to the developing roller 144 satisfies the condition shown in Equation 2 (step S260).

If it is determined that the absolute value of a potential difference between the calculated surface potential of the photosensitive drum 141 and the developing bias voltage applied to the developing roller 144 is less than 200V as a result of the determination in step S260, the control unit 150 controls a charging voltage to be applied to the charging roller 142 in order that the absolute value of the potential difference between the two potentials satisfies the condition of Equation 2 (step S270). The control unit 150 controls the charging voltage adjustment unit 160 in order to increase by a certain amount the current charging voltage applied to the charging roller 142, and repeats step S250. The charging voltage control in the step S270 is performed until the absolute value of the potential difference between the developing bias voltage and the surface potential of the photosensitive drum 141 becomes more than 200V.

In the meantime, if it is determined that the absolute value of the potential difference between the calculated surface potential of the photosensitive drum 141 and the developing bias voltage applied to the developing roller 144 is more than 200V, the control unit 150 determines a charging voltage to be the voltage applied to the charging roller 142, and performs printing tasks (step S280).

As aforementioned, with the electrophotographic image-forming apparatus using a two-component developer and a print density control method thereof according to an example of the present invention, users can select a print density level suitable for printing tasks and perform the printing tasks in the desired print density level. The developing bias voltage corresponding to a print density level selected by a user is supplied to the developing roller, and a charging voltage of the charging roller is controlled automatically based on the developing bias voltage applied to the developing roller. As a result, a secondary factor that degrades the printing quality, which was generated by the conventional way in which the developing bias voltage alone is adjusted, that is, a potential difference between the surface voltage of the photosensitive medium and the developing bias voltage can be prevented.

As described in various embodiments of the present invention, a user is enabled to select a print density level, to thereby properly change a print density based on an amount of a developer loaded in the developing unit so that images of good quality can be obtained all the time.

The foregoing embodiment and advantages are merely exemplary and are not to be construed as limiting the present invention. The present teaching can be readily applied to other types of apparatuses. Also, the description of the embodiments of the present invention is intended to be illustrative, and should not limit the scope of the claims. In addition alternatives, modifications, and variations to the present invention should be apparent to those skilled in the art.

What is claimed is:

1. An electrophotographic image-forming apparatus using a two-component developer, comprising:

a charging roller for charging a surface of a photosensitive medium at a predetermined potential;

a developing unit for developing with a developer an electrostatic latent image formed on the photosensitive medium;

a control unit for determining a bias voltage to be applied to a developing roller of the developing unit in relation to a print density level selected by a predetermined selection unit out of a plurality of print density levels set in varying degrees, calculating a surface potential of the photosensitive medium charged by the charging roller, and controlling a charging voltage to be applied to the charging roller in order that an absolute value of a potential difference between the determined developing bias voltage and calculated surface potential becomes higher than a predetermined potential; and a charging voltage adjustment unit controlled by the control unit, and for variably adjusting the charging voltage to be applied to the charging roller.

2. The electrophotographic image-forming apparatus as claimed in claim 1, further comprising a developing voltage adjustment unit for variably adjusting the developing bias voltage to be applied to the developing roller, wherein the control unit controls the developing voltage adjustment unit in order that the developing bias voltage set in relation to the print density level selected by the predetermined selection unit is applied to the developing roller.

3. The electrophotographic image-forming apparatus as claimed in claim 1, wherein the control unit calculates the surface potential of the photosensitive medium based on an equation as follows:

$$S=-(AX-Y(V)-K),$$

where 'S' denotes the surface potential of the photosensitive medium, 'A' denotes a slope value based on the lifespan characteristics of the photosensitive medium, 'X' denotes a lifespan count value of the developing unit, 'Y(V)' denotes a charging voltage according to environment controls, and 'K' denotes a constant value.

4. The electrophotographic image-forming apparatus as claimed in claim 3, wherein the predetermined potential is about 200V.

5. The electrophotographic image-forming apparatus as claimed in claim 1, further comprising:

a display unit for displaying a print density setting window in relation to a print density setting command; and an input unit for selecting one among the plurality of print density levels displayed on the print density setting window.

6. A print density control method for an electrophotographic image-forming apparatus using a two-component developer provided with a charging roller for charging a surface of a photosensitive medium at a predetermined potential and a developing unit for developing with a two component developer an electrostatic latent image formed on the photosensitive medium, comprising the steps of:

determining a bias voltage to be applied to a developing roller in relation to a print density level selected by a predetermined selection unit out of a plurality of print density levels set in varying degrees;

calculating a surface potential of the photosensitive medium charged by a charging voltage applied to the charging roller; and controlling the charging voltage applied to the charging roller based on the determined developing bias voltage in order that an absolute value of a potential difference between the determined developing bias voltage and calculated surface potential becomes higher than a predetermined potential.

7. The print density control method as claimed in claim 6, wherein the surface potential calculation step calculates the surface potential of the photosensitive medium based on an equation as follows:

$$S=-(AX-Y(V)-K),$$

where 'S' denotes the surface potential of the photosensitive medium, 'A' denotes a slope value based on the lifespan characteristics of the photosensitive medium, 'X' denotes a lifespan count value of the developing unit, 'Y(V)' denotes a charging voltage according to environment controls, and 'K' denotes a constant value.

8. The print density control method as claimed in claim 6, wherein the predetermined potential is about 200V.

* * * * *